US005540138A

United States Patent [19]

Robbins, Jr.

[11] Patent Number: 5,540,138

[45] Date of Patent: Jul. 30, 1996

[54] LOCKUP AND RELEASE DEVICE

[76] Inventor: Roland W. Robbins, Jr., 1641 McCulloch Blvd., 25-294, Lake Havasu City, Ariz. 86403

[21] Appl. No.: 114,907

[22] Filed: Sep. 2, 1993

[51] Int. Cl.[6] ..... F15B 15/26

[52] U.S. Cl. ..... 92/26; 92/23; 92/27; 92/5 L

[58] Field of Search ..... 92/23, 24, 26, 92/27, 28, 30, 52, 14

[56] References Cited

U.S. PATENT DOCUMENTS

| | | | |
|---|---|---|---|
| 2,093,634 | 9/1937 | Cordes | 92/30 |
| 2,786,450 | 3/1957 | Jacobus et al. | 92/30 |
| 2,876,743 | 3/1959 | Storrs | 92/28 |
| 2,933,068 | 4/1960 | Johnson et al. | 92/30 |
| 3,128,684 | 4/1964 | Bade | 92/30 |
| 3,135,171 | 6/1964 | Michalak, Jr. | 92/30 |
| 3,397,617 | 8/1968 | Cast et al. | 92/30 |
| 3,596,946 | 8/1971 | Burton et al. . | |
| 3,969,988 | 7/1976 | Maurer | 92/26 |
| 4,024,800 | 5/1977 | Masclet | 92/30 |
| 4,037,839 | 7/1977 | Nelson . | |
| 4,167,891 | 9/1979 | Kamimura | 92/5 L |
| 4,598,572 | 7/1986 | Mondello et al. . | |
| 5,026,246 | 6/1991 | Bay et al. | 92/30 |
| 5,107,930 | 4/1992 | Hopper . | |

FOREIGN PATENT DOCUMENTS

| | | | |
|---|---|---|---|
| 538688 | 3/1957 | Canada | 92/26 |
| 1807273 | 1/1968 | Germany | 92/30 |
| 2505358 | 2/1975 | Germany | 92/27 |
| 184144 | 9/1966 | U.S.S.R. | 92/28 |
| 442325 | 11/1971 | U.S.S.R. | 92/27 |
| 581833 | 10/1946 | United Kingdom | 92/26 |
| 922808 | 4/1963 | United Kingdom | 92/28 |

*Primary Examiner*—Thomas E. Denion

[57] ABSTRACT

A coupling mechanism, comprising a relatively fixed member and a relatively moveable member, is configured such that said moveable member may be securely connected in a locked position with said relatively fixed member by remote control of a shiftable member mounted on said relatively moveable member, and which shiftable member may be moved by remote control, into a position allowing disconnection, when desired.

3 Claims, 2 Drawing Sheets

LOCKUP AND RELEASE DEVICE

BACKGROUND OF THE INVENTION

1. Field of the Invention

This invention relates to a remotely controllable mechanism for mechanically locking two mechanical elements together and, integral thereto, additional means for releasing said locking means.

Locking mechanisms are sometimes required in systems which have limited access and little space. The locks hold the actuator in the extended or retracted position without hydraulic pressure or electric power, even when the actuator is under load. These actuators may also require internal position switches that indicate the beginning and end of strokes, or indicate when the locks have engaged or released. Most actuators that include these features are considerably larger than actuators that do not. Some require additional hydraulic venting connections to vent the locking mechanism, which also increases the volume occupied by the actuator. A compact, locking actuator design is needed that can operate reliably in adverse environments for long periods of time.

2. Description of the Prior Art

In Brian C. Mondello, U.S. Pat. No. 4,598,572, for instance, lockup cannot be achieved as one continuous, uninterrupted motion triggered only by the linear motion of one of the elements. The moving element 25 cannot lock up with the jaw member 48 unless the tubular collet member 34 moves after engagement of 31. This mechanism cannot be adapted to perform the function of the grippers and detent of the present invention. Even if element 48 is considered as the single moving element, it cannot lock securely without some other action by one of the other elements.

In Charles A. Burton, U.S. Pat. No. 3,596,946, there is a friction lock requiring a rotary motion as well as a linear positioning motion. The lockup cannot be achieved by a simple linear engagement of the moving elements. This device is not suitable for high force levels such as the presently disclosed gripper and detent mechanism.

In Hans P. Hopper, U.S. Pat. No. 5,107,930, although the trigger dogs 31 seem to be closely related to grippers, the overall mechanism which includes the trigger dogs cannot possibly be reduced to perform the function of the gripper and detent disclosed herein.

SUMMARY OF THE INVENTION

The actuator of the present invention includes a compact locking mechanism and a miniature reed switch with fine adjustment capability. The locking mechanism requires no additional hydraulic connections for the locking feature, and will unlock while under full load as smoothly and quietly as when under zero load.

The purpose of the subject invention is to provide a means for mechanically locking two mechanical elements to each other and, integral to said locking means, to provide an additional means for releasing said lock.

This is easily accomplished on an actuator that pushes against a load while extending and then locks extended against a load. A "pulling" actuator that retracts under load and locks retracted must be double ended (a rod protruding from each end) for this concept to work. In many cases, actuators push out under load and retract either unloaded or with an overrunning load such as the weight of the object being lifted.

BRIEF DESCRIPTION OF THE DRAWINGS

FIGS. 1*a*–l*c* depict, in three longitudinal cross-sectional views, a linear hydraulic actuator in a series of events in the unlocking of the actuator to allow extension of the actuator rod to do work.

DESCRIPTION OF PREFERRED EMBODIMENT

Figure 1A:
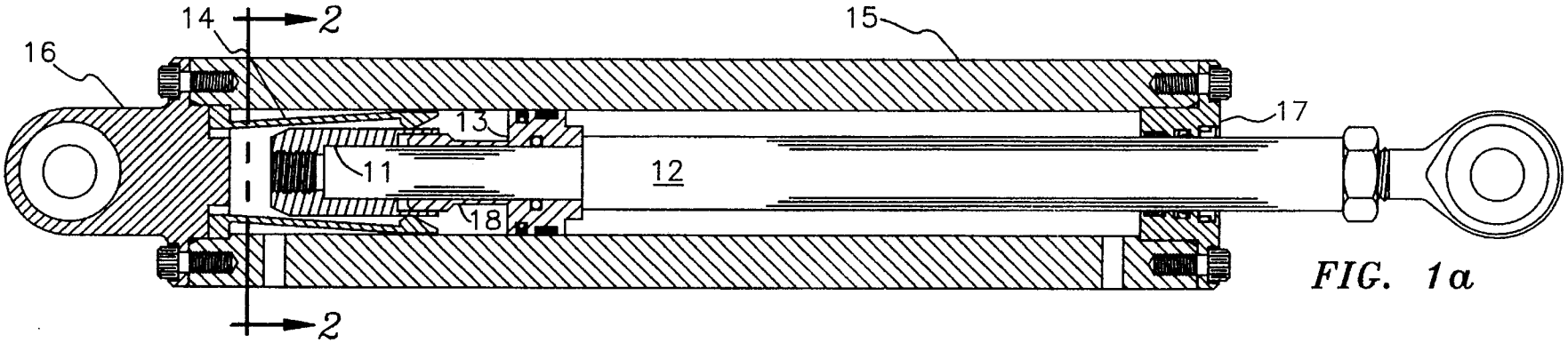
Figure 1B:
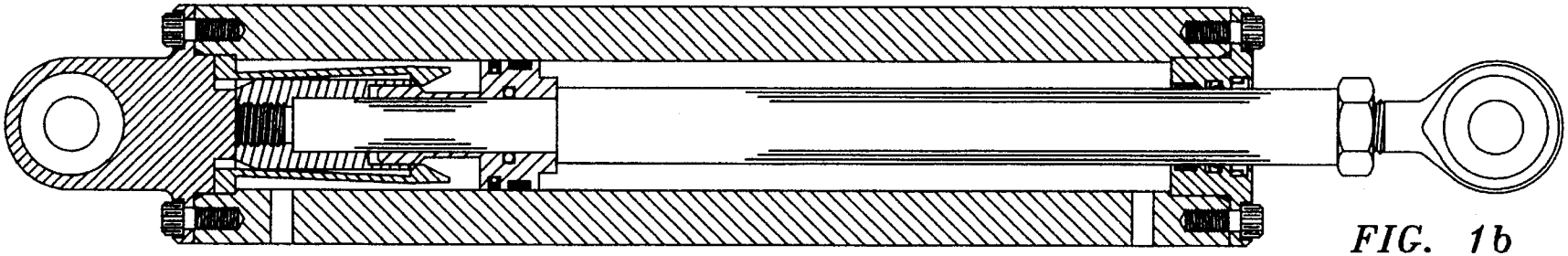
Figure 1C:
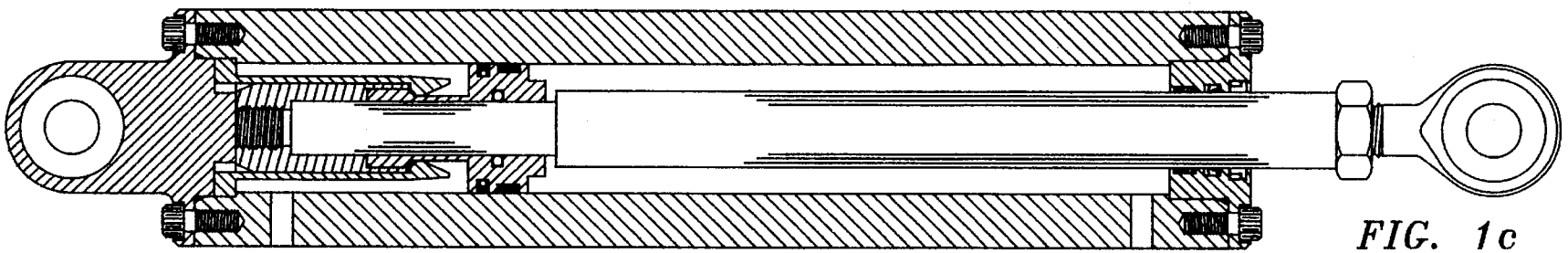

Referring to FIGS. 1*a*–1*c*, cylindrical detent 11 is fixedly attached to actuator rod 12. Cylindrical piston 13 is slidably engaged to rod 12 but is limited in its range of axial motion on rod 12 by the stepped diameter shown on rod 12 and by the bottom of the counterbore within detent 11. Cylindrically arrayed flexible grippers 14 are fixedly attached to cylinder 15. In this instance flexible grippers 14 comprise a plurality of slender elements free to flex in a radial direction. End caps 16 and 17 complete the structure of the hydraulic actuator and incorporate a fluid seal means around said actuator rod (end cap 17) and a fluid seal means plus an attachment means (end cap 16). Cylindrical detent 11, piston rod 12 and cylindrical piston 13 are free to move axially as a unit within cylinder 15, limited only by the mechanical limits created by end caps 16 and 17.

FIG. 1*a* shows cylindrical detent 11, actuator rod 12 and cylindrical piston 13 moving as a unit toward the base of the array of grippers 14. Said motion being caused by the application of fluid pressure to the right side of piston 13, according to the sketch. In this view, detent 11 has engaged grippers 14 and, by virtue of the sloping ramp-like features on both parts, has radially displaced grippers 14 in an outward direction, thereby allowing detent 11 to move axially within the cylindrical array of grippers 14.

FIG. 1*b* shows detent 11 in firm contact with the base end of grippers 14 with piston extension 18 about to move slightly further axially to engage the bottom surface of the counterbore within detent 11 mounted on the innermost end of said connecting rod 12. Said motion being caused by the abovementioned fluid pressure.

FIG. 1*c* shows piston extension 18 firmly contacting the bottom surface of the counterbore within detent 11. At the instant of contact, flexible grippers 14 are free to move inward radially and by so doing fixedly engage the cylindrical shell comprising the right edge of detent 11. At this point, it is important to note that the sloping, cylindrical surface, shown at the reduced diameter of piston 13, is not in firm contact with the proximate sloping surface of flexible grippers 14 and, in fact, there is a gap of a slight and predetermined magnitude. At this point the mechanical lockup of the fixed and moving elements has been achieved. An axial force applied outward and simultaneously to both the rod 12 and the end cap 16 will not cause any relative motion between these elements other than a take up of mechanical tolerances within the mechanism, which will be of a minuscule amount.

To release the mechanical lockup, it is only necessary to apply fluid pressure to the left face of piston 13. The application of fluid pressure causes piston 13 to move toward the right, as shown in the sketch, thereby causing the sloping cylindrical surface at the reduced diameter of piston extension 18 to contact the proximate sloping surface of grippers 14. Further axial motion of piston 13 forces grippers 14 to move radially outward, thereby releasing their hold on detent 11. Further axial motion yet, of piston 13, moves the unit comprising piston 13, detent 11 and piston rod 12, toward the right, as shown in the sketch, until the physical boundary of end cap 17 is encountered.

Figure 3:
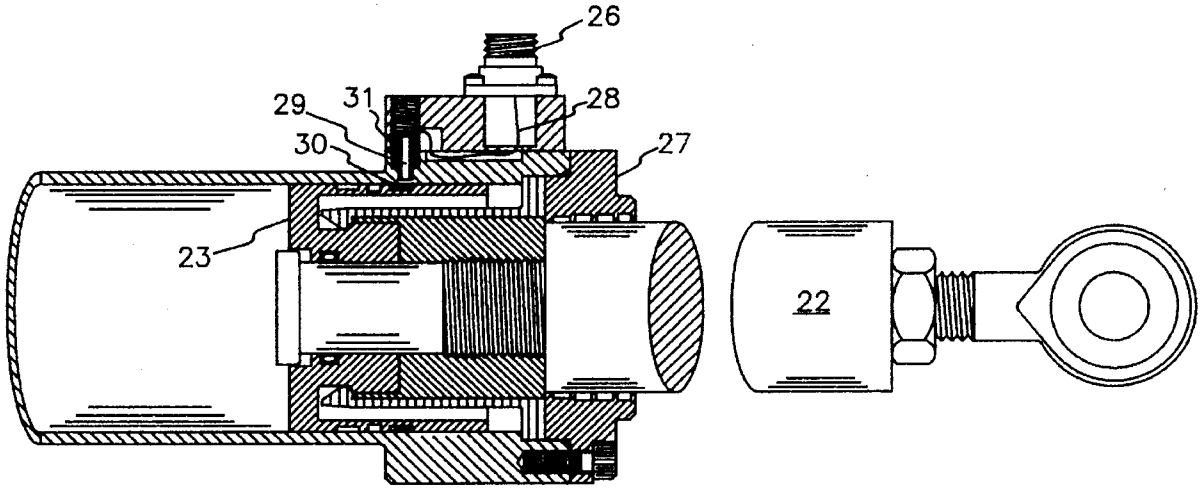
FIG. 3 is a longitudinal cross-sectional view of a locking mechanism for securing an actuator rod in the fully extended position.
Figure 2:
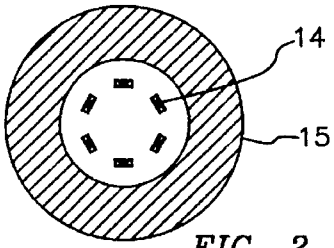
FIG. 2 is a cross sectional view taken along line 2—2 of FIG. 1*a* showing the arrangement of grippers 14 within cylinder 15.

The actuator of FIG. 3 operates in a similar manner to that of FIGS. 1*a*–*lc* to lock actuator rod 22 in the fully extended position. Also included in FIG. 3 is a miniature reed switch 29 with fine adjustment feature 31. The switch is activated by a ring magnet 30 on piston 23 to signal when the piston is in "locked" position.

A ferrous but non-magnetized threaded sleeve surrounds the reed switches and shields it from the magnetic field until the magnet is at the desired triggering position (FIG. 3). Screwing the threaded sleeve in or out adjusts the triggering position to the exact location desired. Triggering repeatability has been shown in tests to be better than 0.001". The dead band between the "trigger on" and "trigger off" position can be adjusted by shimming the switch outward radially away from the piston's magnetic field.

By virtue of the above teachings it will be obvious to any skilled person that the above mechanism may be applied to a limitless variety of mechanical devices other than the linear hydraulic actuator shown in the instant disclosure. For example, the subject invention may be modified and applied to the coupling of railway cars or to the requirements of docking orbiting space vehicles.

What is claimed is:

1. In a hydraulic actuator means comprising a relatively stationary cylinder and a relatively moveable member comprising a one piece piston fitted within said cylinder and having a connecting rod affixed thereto;

the improvement comprising: said piston being movably mounted on an inner end of said connecting rod for limited movement between a locking and an unlocking position, locking means including a knob protruding centrally from said piston, a receiving piece mounted on an innermost end of said connecting rod for receiving said knob and limiting movement of said piston on said connecting rod, and locking means including a cylindrical array of locking fingers protruding from the end of said cylinder and spanning said knob for locking when said piston is fully received within said receiver piece, said fingers being so shaped as to ride up on said knob when said piston is moved outward of said receiver piece for moving said fingers sufficiently for unlocking said piston for movement.

2. The apparatus of claim 1 including position indicating means for remotely indicating when said moveable member is in its locked position.

3. The apparatus of claim 2 wherein said position indicating means includes a reed switch mounted on said cylinder and a magnetic band on said moveable member such that said reed switch closes a circuit when in juxtaposition with said magnetic band.

* * * * *